US007950363B2

(12) United States Patent
Currie et al.

(10) Patent No.: US 7,950,363 B2
(45) Date of Patent: May 31, 2011

(54) AIR INLET SYSTEM FOR INTERNAL COMBUSTION ENGINE

(75) Inventors: David Currie, New Hudson, MI (US); Ivan Lazich, Skokie, IL (US); John Jasso, Grosse Ile, MI (US); Anthony William Hudson, Highland, MI (US)

(73) Assignee: Ford Global Technologies, Dearborn, MI (US)

( * ) Notice: Subject to any disclaimer, the term of this patent is extended or adjusted under 35 U.S.C. 154(b) by 396 days.

(21) Appl. No.: 12/209,445

(22) Filed: Sep. 12, 2008

(65) Prior Publication Data

US 2010/0065005 A1 Mar. 18, 2010

(51) Int. Cl.
*F02M 35/10* (2006.01)
*F02B 77/13* (2006.01)

(52) U.S. Cl. ..... 123/184.57; 123/184.47; 181/204; 181/229

(58) Field of Classification Search ..... 123/184.57, 123/184.24–184.26, 184.32–184.36, 184.42, 123/184.44, 184.47–184.51; 181/204, 229
See application file for complete search history.

(56) References Cited

U.S. PATENT DOCUMENTS

| | | | | |
|---|---|---|---|---|
| 3,990,414 | A * | 11/1976 | Malphettes | 123/184.57 |
| 4,327,698 | A | 5/1982 | Hamai et al. | |
| 4,329,843 | A | 5/1982 | Inoue et al. | |
| 4,879,980 | A | 11/1989 | Piazzo | |
| 4,993,227 | A | 2/1991 | Nagura et al. | |
| 5,207,714 | A | 5/1993 | Hayashi et al. | |
| 5,477,819 | A * | 12/1995 | Kopec | 123/184.57 |
| 5,523,063 | A | 6/1996 | Anderson | |
| 6,205,968 | B1 * | 3/2001 | Spannbauer | 123/184.57 |
| 6,470,867 | B2 | 10/2002 | Akiwa et al. | |
| 6,513,506 | B1 | 2/2003 | Ito et al. | |
| 6,622,486 | B2 * | 9/2003 | Jarvi | 123/184.57 |
| 6,672,296 | B2 | 1/2004 | Ito et al. | |
| 6,776,146 | B1 | 8/2004 | Ricart-Ugaz et al. | |
| 6,889,673 | B2 | 5/2005 | Bender et al. | |
| 7,082,915 | B2 * | 8/2006 | Tanikawa et al. | 123/184.57 |
| 7,140,357 | B2 | 11/2006 | Wei et al. | |
| 7,198,017 | B2 * | 4/2007 | Vogt et al. | 123/184.57 |
| 7,243,641 | B2 | 7/2007 | Zukouski | |
| 7,363,761 | B1 | 4/2008 | Dickerson | |
| 2002/0088443 | A1 | 7/2002 | Marthaler et al. | |
| 2004/0094112 | A1 * | 5/2004 | Hoffmann et al. | 123/184.57 |

FOREIGN PATENT DOCUMENTS

| | | |
|---|---|---|
| JP | 8284767 | 10/1996 |

OTHER PUBLICATIONS

Arnold, "Single Sequential Turbocharger: A New Boosting Concept for Ultra-Low Emission Diesel Engines," SAE Technical Paper Series, SAE International, Apr. 14-17, 2008 World Congress, Detroit, MI, USA.

* cited by examiner

*Primary Examiner* — Noah Kamen
(74) *Attorney, Agent, or Firm* — Jerome R. Drouillard; Julia Voutyras

(57) ABSTRACT

An air inlet system for an internal combustion engine includes an air inlet duct for drawing charge air into a charge air processor, and an intake manifold system leading from the charge air processor to the power cylinders of the engine. A resonator which suppresses pressure pulses within the inlet duct is mounted to the intake manifold system, but fluidically connected to the air inlet duct, and not to the intake manifold system.

15 Claims, 4 Drawing Sheets

AIR INLET SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to an internal combustion engine having an air inlet system with one or more resonators for controlling noise emissions from the engine.

2. Related Art

The development process for modern automotive internal combustion engines typically includes a good deal of work directed to developing an appropriate sound output characteristic for an engine. The development process often includes use of one or more resonators in the engine's air inlet system to achieve noise emission characteristics appropriate for the engine and vehicle in question. Of course, resonators require package space in an underhood environment of a vehicle, and add weight and material cost.

It would be desirable to provide a resonator which combines functional attributes of more than one component, while being packaged in a convenient fashion with an engine, and at minimal weight.

SUMMARY OF THE INVENTION

According to an aspect of the present invention, an air inlet system for an internal combustion engine includes an inlet duct for drawing charge air into an engine, and a charge air processor for conditioning air flowing from the inlet duct. An intake manifold system receives charge air from the charge air processor. The intake manifold system provides charge air to the power cylinders of the engine. At least one resonator suppresses pressure pulses within the inlet duct. At least one resonator is mounted to the intake manifold system but has a tuning passage for connecting the resonator's tuning volume to the inlet duct. According to another aspect of the present invention, the resonator is fluidically isolated from the intake manifold system, but communicates fluidically with the inlet duct.

According to another aspect of the present invention, the charge air processor may include a turbocharger, or an intercooler, or both.

According to another aspect of the present invention, a resonator conducts crankcase gases from a gas/oil separator to an air inlet duct. The resonator suppresses pressure pulses within the inlet duct so as to modify the engine's sound emission signature, to achieve a desired tuning.

According to another aspect of the present invention, an internal combustion engine includes a cylinder block, a number of power cylinders located within the cylinder block, and a crankshaft mounted within the cylinder block. Pistons are mounted within the power cylinders upon connecting rods. An inlet duct draws charge air into the engine. A charge air processor including a turbocharger and an intercooler conditions charge air flowing from the inlet duct. An intake manifold system receives charge air from the charge air processor and provides charge air to the power cylinders of the engine. At least one resonator suppresses pressure pulses within the inlet duct, with the resonator being mounted to the intake manifold system and with the resonator communicating fluidically with the inlet duct, while being isolated fluidically from the intake manifold system. The cylinder block may be configured in a V configuration, and an additional resonator may be coupled to the intake manifold and the air inlet duct.

Is an advantage of an air inlet system according to the present invention that resonators may be provided in a compact fashion, with a V-block engine having an air inlet system nestled in the V defined by the cylinder banks of the engine.

It is another advantage of an air inlet system according to present invention that resonators may be fabricated from lighter weight material commonly used for an intake manifold system, as opposed to forming the resonators from heavier materials, such as metals, which are commonly used for more highly stressed portions of an air intake system.

It is another advantage of a resonator system according to present invention that attaching the resonators to an intake manifold system, while not providing any fluidic connection with the intake manifold system, allows easy attachment of the resonators to the engine assembly.

Other features, as well as advantages of the present invention, will become apparent to the reader of this specification.

DETAILED DESCRIPTION OF THE PREFERRED EMBODIMENTS

Figure 4:
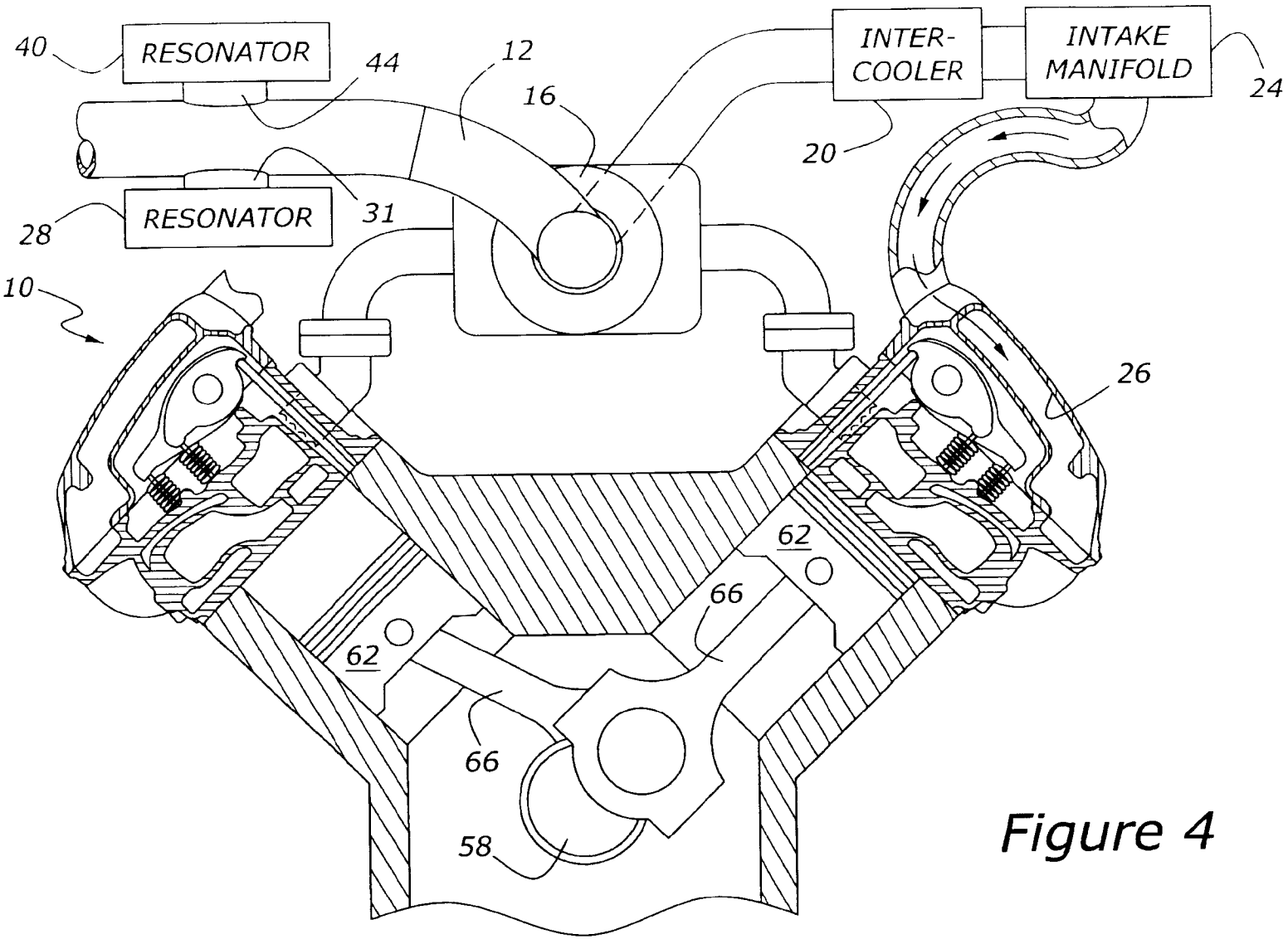
FIG. 4 is a schematic representation of an engine having an air inlet system according to the present invention, shown as a vertical section through the engine, partially broken away.

As shown in FIG. 4, engine 10 has an air inlet duct, 12, with two resonators, 28 and 40 attached thereto by means of tuning passages 31 and 44 respectively. Engine 10 also includes pistons 62, connecting rods 66 and a crankshaft, 58. The air inlet system further includes intercooler 20 and intake manifold 24. Those skilled in the art will appreciate in view of this disclosure that FIG. 4 is a schematic representation of the present engine and shows parts separated for sake of clarity, whereas in the actual embodiment, each of the components is mounted closer to the valley of the engine, as is suggested by the other drawing figures in this case.

Figure 1:
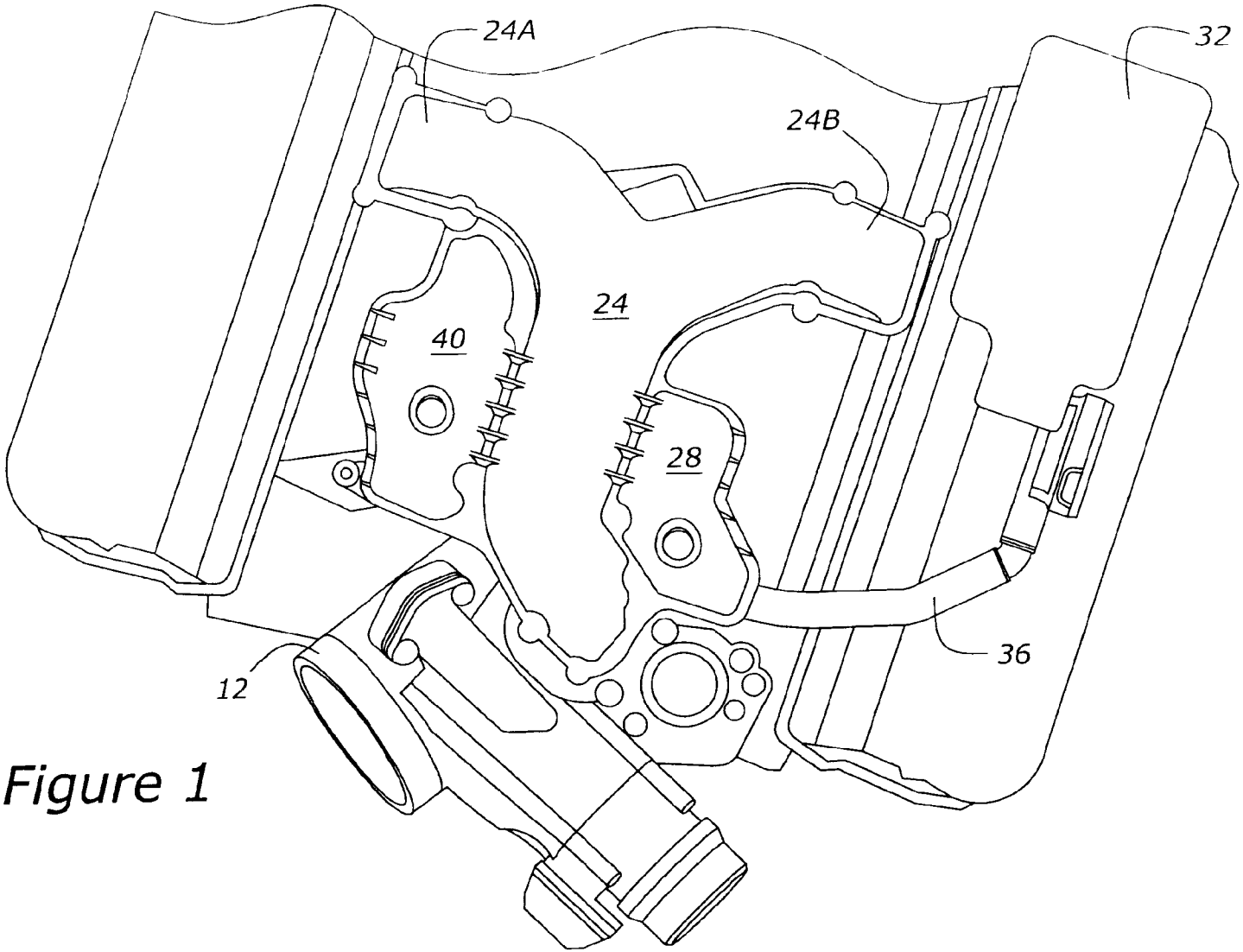
FIG. 1 is a plan view of an engine having an air inlet system according to the present invention.

FIG. 1 shows greater detail of resonators 28 and 40. Notice that resonators 28 and 40 are attached to intake manifold system 24, having two branches 24A and 24B. Resonators 28 and 40 are attached with ribbed connections to intake manifold system 24. FIG. 1 also shows inlet duct 12, and a closed crankcase ventilation ("CCV") inlet hose 36, which is connected with a gas/oil separator 32 mounted upon engine 10.

Figure 2:
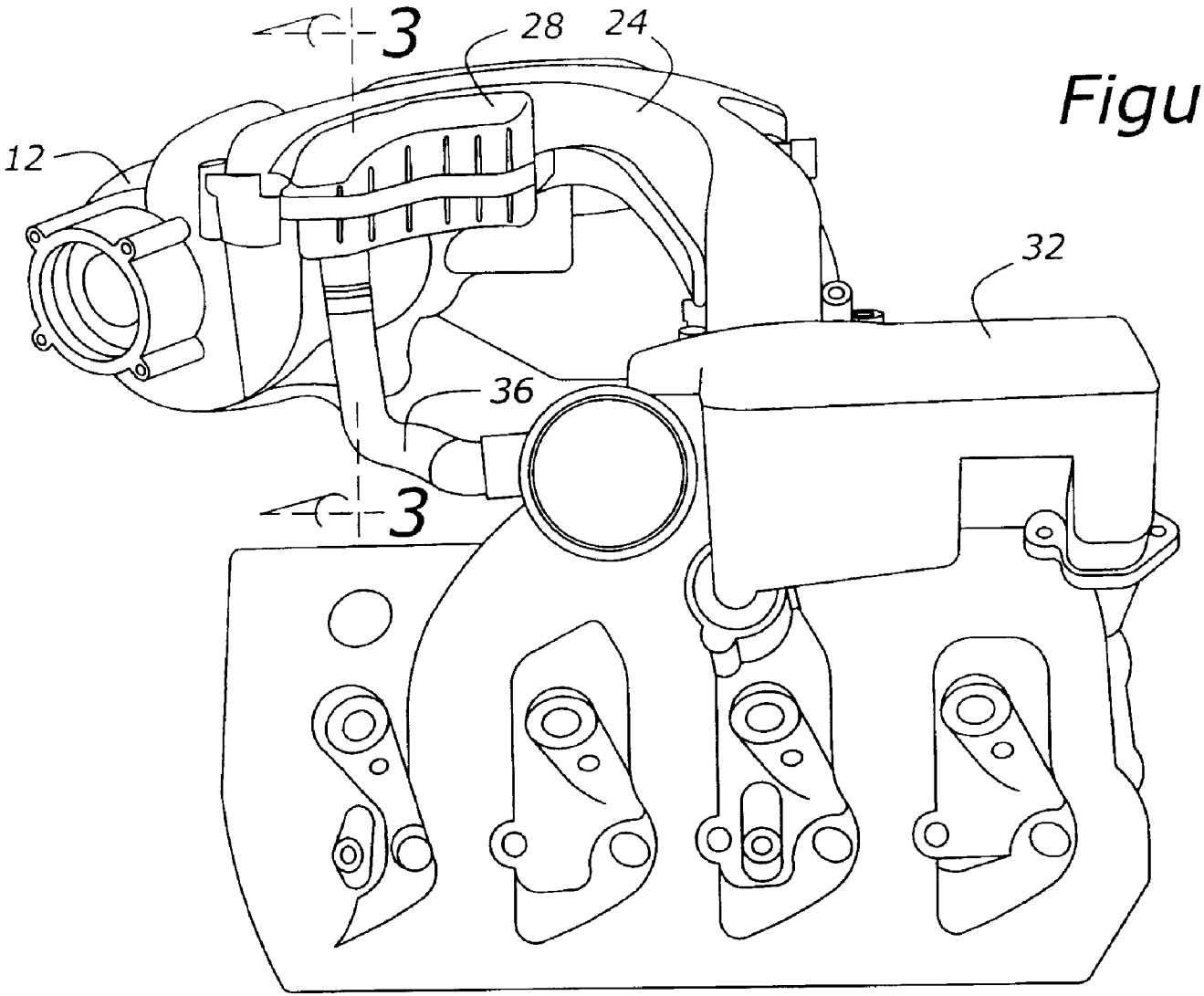
FIG. 2 is a side elevation of an engine having an air inlet system according to the present invention.

FIG. 2 is a side view showing with particularity CCV hose 36, gas/oil separator 32, and resonator 28, as well as intake manifold system 24.

Figure 3:
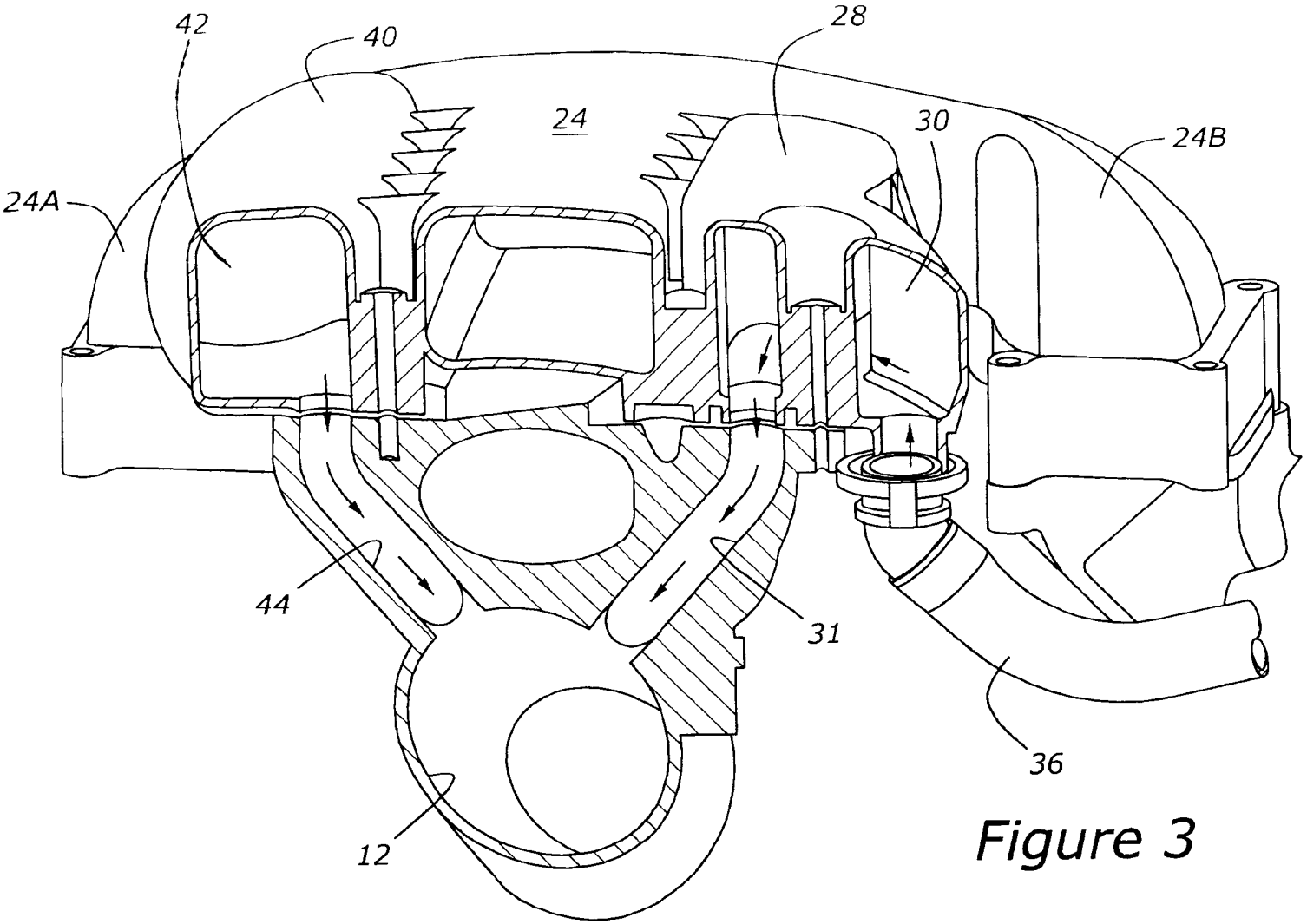
FIG. 3 is a sectional view taken along a vertical plane of an engine according to the present invention, shown taken along the lines 3-3 of FIG. 2.

FIG. 3 shows tuning passages 30, 31 and 44. Passage 31 extends from resonator 28 to air inlet duct 12. Notice also in FIG. 3 that resonator 28 is clearly shown as being connected with CCV inlet hose 36, allowing crankcase gases, which commonly begin as blow-by and which flow from gas/oil separator 32, to enter into inlet duct 12. Because inlet duct 12 is mounted upstream from turbocharger 16, the pressure within inlet duct 12 is lower than crankcase pressure, thereby providing crankcase gases with a means for being drawn from the crankcase and into the engine's inlet system.

Each of resonators 28 and 40 (FIG. 3) has a tuning volume which is labeled 30, in the case of resonator 28, and 42, in the case of resonator 40. Tuning volume 30 communicates fluidically with air inlet duct 12 by means of tuning passage 31. By the same token, tuning volume 42 communicates with air inlet duct 12 by means of tuning passage 44. Each resonator functions as a Helmholtz resonator because it is communicated with a tuning passage by means of a tuned length and diameter tuning passage. Notice from the various drawings that there is no fluidic communication between either of resonators 28 and 40 and intake manifold system 24. What intake manifold system 24 does provide however, is a convenient mounting bracket for resonators 28 and 40. Because intake manifold system 24 is mounted at an upper part of the engine, resonators 28 and 40 are able to be mounted in the same relative plane as intake manifold system 24, allowing resonators 28 and 40 to be engaged with inlet duct 12, which extends below intake manifold system 24, with a proper Helmholtz resonator configuration.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. An air inlet system for an internal combustion engine, comprising:

an inlet duct for drawing charge air into an engine;

a charge air processor for conditioning charge air flowing from said inlet duct;

an intake manifold system for receiving charge air from said charge air processor, with said intake manifold system providing said charge air to the power cylinders of an engine; and at least one resonator for suppressing pressure pulses within said inlet duct, with said at least one resonator being mounted to said intake manifold system wherein said at least one resonator conducts crankcase gases from a gas/oil separator to said inlet duct.

2. An air inlet system according to claim 1, wherein said charge air processor comprises a turbocharger.

3. An air inlet system according to claim 1, wherein said charge air processor comprises a turbocharger followed by an intercooler.

4. An air inlet system according to claim 1, wherein said at least one resonator comprises a Helmholtz resonator.

5. An air inlet system according to claim 1, wherein said at least one resonator is connected to said inlet duct upstream from said intake manifold system.

6. An air inlet system according to claim 1, wherein said at least one resonator and said intake manifold system are unitary.

7. An air inlet system according to claim 1, wherein said at least one resonator comprises a tuning volume connected to said inlet duct by a tuning passage.

8. An air inlet system for an internal combustion engine, comprising:

an inlet duct for drawing charge air into an engine;

a charge air processor, comprising a turbocharger and an intercooler, for conditioning charge air flowing from said inlet duct;

an intake manifold system for receiving charge air from said charge air processor, with said intake manifold system providing said charge air to the power cylinders of an engine; and at least one resonator for suppressing pressure pulses within said inlet duct, with said at least one resonator being mounted to said intake manifold system, and with said at least one resonator connected fluidically with said inlet duct at a location upstream, from said intake manifold system.

9. An air inlet system according to claim 8, further comprising a second resonator mounted to said intake manifold system and connected with said inlet duct at a location upstream from said intake manifold system.

10. An air inlet system according to claim 9, wherein said at least one resonator and said second resonator comprise Helmholtz resonators.

11. An air inlet system according to claim 9, wherein said at least one resonator conducts crankcase gases from a gas/oil separator to said inlet duct.

12. An internal combustion engine, comprising:

a cylinder block;

a plurality of power cylinders located within said cylinder block;

a crankshaft mounted within said cylinder block;

a plurality of pistons mounted within said power cylinders, with said pistons being connected with said cylinder block with a plurality of connecting rods;

an inlet duct for drawing charge air into the engine;

a charge air processor, comprising a turbocharger and an intercooler, for conditioning charge air flowing from said inlet duct;

an intake manifold system for receiving charge air from said charge air processor, with said intake manifold system providing said charge air to said power cylinders of the engine; and at least one resonator for suppressing pressure pulses within said inlet duct, with said at least one resonator being mounted to said intake manifold system, and with said at least one resonator communicating fluidically connected with said inlet duct at a location which is upstream, from said intake manifold system.

13. An internal combustion engine according to claim 12, wherein said cylinder block is configured in a V configuration.

14. An air inlet system according to claim 12, wherein said at least one resonator and said intake manifold system are unitary.

15. An air inlet system according to claim 12, wherein said at least one resonator comprises a tuning volume which also receives crankcase gases from a gas/oil separator associated with a CCV system within the engine, with said tuning volume having an outlet passage for conveying said crankcase gases to said inlet duct, while communicating fluidically with said inlet duct.

* * * * *